US011364424B2

(12) United States Patent
Moody, Jr. et al.

(10) Patent No.: US 11,364,424 B2
(45) Date of Patent: Jun. 21, 2022

(54) PROTECTIVE TRAVEL CASE FOR EQUIPMENT

(71) Applicant: CLUB CAGE, LLC, Danbury, CT (US)

(72) Inventors: Joseph T. Moody, Jr., Danbury, CT (US); Joseph Biraglia, Danbury, CT (US)

(73) Assignee: CLUB CAGE, LLC, Danbury, CT (US)

( * ) Notice: Subject to any disclaimer, the term of this patent is extended or adjusted under 35 U.S.C. 154(b) by 0 days.

(21) Appl. No.: 17/137,253

(22) Filed: Dec. 29, 2020

(65) Prior Publication Data

US 2021/0205679 A1 Jul. 8, 2021

Related U.S. Application Data

(60) Provisional application No. 62/956,915, filed on Jan. 3, 2020.

(51) Int. Cl.
*A63B 55/00* (2015.01)
*A45C 7/00* (2006.01)

(52) U.S. Cl.
CPC .... *A63B 55/406* (2015.10); *A45C 2007/0004* (2013.01)

(58) Field of Classification Search
CPC ..... A63G 55/406; A63G 55/404; A45C 2007/0004
See application file for complete search history.

(56) References Cited

U.S. PATENT DOCUMENTS

| | | | | | |
|---|---|---|---|---|---|
| 858,488 | A | | 7/1907 | Tynes | |
| 1,155,475 | A | | 10/1915 | Fay | |
| 1,206,618 | A | | 11/1916 | Thrasher et al. | |
| 1,644,592 | A | | 10/1927 | Howland | |
| 1,918,447 | A | | 7/1933 | Blatz | |
| 2,070,254 | A | | 2/1937 | Burgner | |
| 2,435,479 | A | | 2/1948 | Thommen | |
| 2,653,826 | A | | 9/1953 | Lu | |
| 2,747,637 | A | * | 5/1956 | Brown | A63B 55/406 150/159 |
| 2,752,973 | A | | 7/1956 | Stamp | |
| 2,879,819 | A | | 3/1959 | Turnbull | |
| 3,288,189 | A | * | 11/1966 | Davis | A63B 55/406 150/159 |
| 4,078,594 | A | | 3/1978 | Oeckl | |
| 4,420,024 | A | * | 12/1983 | Clayton | A63B 60/64 206/315.4 |

(Continued)

FOREIGN PATENT DOCUMENTS

WO 2017161209 9/2017

*Primary Examiner* — Christopher R Harmon
(74) *Attorney, Agent, or Firm* — Ware, Fressola, Maguire & Barber LLP

(57) ABSTRACT

An apparatus or case for protecting a golf bag or other equipment is provided that includes a protective mat having a skeletal support structure that can be wrapped around the golf bag or other equipment to protect the golf bag or equipment during travel. The apparatus is configured to conveniently fit into a duffel or travel bag for transport, and also to be rolled up into a narrowed, spiral configuration for storage when it is not in use, and may be expandable to adjust in diameter depending on the size of the article encased.

14 Claims, 18 Drawing Sheets

(56) References Cited

U.S. PATENT DOCUMENTS 4,512,465 A 4/1985 Jobe
4,522,300 A 6/1985 Hamblet
4,635,793 A 1/1987 Kim
4,657,135 A 4/1987 Kjose
4,788,996 A 12/1988 Forshee
4,858,763 A 8/1989 Scott
4,865,192 A 9/1989 Williams
4,905,827 A 3/1990 Kim
4,915,221 A 4/1990 Spangler
4,953,768 A * 9/1990 Muse ..... A63B 55/57 224/613
4,968,048 A * 11/1990 Lortie ..... A63B 71/0045 280/47.19
5,209,280 A 5/1993 Gevas
5,220,950 A * 6/1993 Cordasco ..... A63B 55/406 150/159
5,244,086 A 9/1993 Welch
5,437,320 A 8/1995 Sung
5,443,156 A * 8/1995 Shioda ..... A63B 55/406 150/159
5,515,897 A 5/1996 Fehan
5,620,034 A 4/1997 Flis
5,624,035 A * 4/1997 Kim ..... B65D 81/052 206/521
5,699,906 A 12/1997 Lombardo et al.
5,738,208 A 4/1998 Roubal
5,860,519 A 1/1999 Meyer et al.
5,921,387 A 7/1999 Arzoomanian et al.
5,941,383 A 8/1999 Cheng
5,975,170 A 11/1999 Anguiano
6,029,813 A 2/2000 Smolenski
6,149,041 A 11/2000 Perino et al.
6,161,698 A * 12/2000 Bradshaw ..... A63B 55/408 206/527
6,202,840 B1 3/2001 Chang
6,217,042 B1 4/2001 Kurtz et al.
6,273,251 B1 8/2001 Rust
6,286,673 B1 * 9/2001 Robertson ..... A45C 11/26 206/315.3
6,298,987 B1 10/2001 Clark
6,557,702 B1 5/2003 Sanderson et al.
6,595,356 B1 7/2003 Homoly
6,612,412 B2 9/2003 Sanderson et al.
6,629,601 B1 * 10/2003 Russell ..... A63B 55/40 206/315.3
8,469,068 B2 * 6/2013 Johnson ..... B23P 19/04 150/159
9,079,076 B2 7/2015 Weinmeier
9,114,759 B1 8/2015 Hudson et al.
10,004,961 B2 6/2018 Pittman
10,543,416 B1 1/2020 Moody, Jr. et al.
2003/0168362 A1 9/2003 Yoshida
2004/0182726 A1 9/2004 Wang
2004/0232016 A1 11/2004 Dietrich
2005/0167303 A1 * 8/2005 Burgess ..... A63B 55/00 206/315.3
2006/0185999 A1 8/2006 Keays
2008/0035691 A1 2/2008 Losos
2009/0308768 A1 12/2009 Quartarone
2010/0147714 A1 6/2010 Andochick
2010/0237576 A1 9/2010 Maccario
2013/0032557 A1 * 2/2013 Porath ..... A45C 9/00 211/85.7
2015/0102080 A1 * 4/2015 Bullock ..... A45C 7/0077 224/577
2017/0095712 A1 * 4/2017 Johnston ..... A63B 55/10
2018/0242718 A1 * 8/2018 Hanson ..... A45C 7/0095

* cited by examiner

PROTECTIVE TRAVEL CASE FOR EQUIPMENT

CROSS-REFERENCE TO RELATED APPLICATIONS

The present application claims the benefit of U.S. Provisional Patent Application No. 62/956,915, filed Jan. 3, 2020, which is hereby incorporated by reference in its entirety.

FIELD OF THE INVENTION

The present invention relates to a protective travel case for sports equipment, such as golf clubs, to protect the equipment from damage during travel.

BACKGROUND OF THE INVENTION

There are several difficulties associated with traveling with golf clubs and other types of sporting equipment, particularly when traveling by airplane. Given the size of a golf bag carrying golf clubs, a golf bag is generally checked as baggage at the airport and is not in the owner's possession during much of travel. A large duffel bag or other soft bag can be used to carry and store the golf bag as luggage during travel. However, such bags are exposed to strikes or blows during transport, such as, for example, if another item of luggage falls on top of the golf bag in the airport or in the baggage compartment of the plane. This can cause damage to the golf clubs in the golf bag, which have narrow shafts that can be prone to bending or breaking due to various forces applied to the shaft or club head. The longer clubs, particularly the driver, which is the longest club in the bag, can be prone to club head damage. In addition to the inconvenience and the potential expense for replacing a broken golf club, if a golf club is broken or bent during air travel to a destination where the golf clubs are to be used, it may not be possible to replace or repair the club at the destination particularly given the golf industry's focus on customizing golf clubs for individual golfers, making the replacement process much more lengthy and specialized.

In view of these problems, rigid carrying cases are available for golf clubs, which are large enough to fit a golf bag including clubs and sufficiently solid and durable so as to protect the clubs from damage, such as if the carrying case is struck by another piece of luggage. However, these carrying cases are quite large and bulky, meaning that for many consumers, the carrying case cannot fit in their cars to transport the case and golf clubs, and the case is inconvenient to travel with.

There is therefore a need in the art for a device that can allow a traveler to adequately protect golf clubs or other equipment from damage during travel while avoiding the need to transport an excessively large or unwieldy case.

SUMMARY OF THE INVENTION

The present application addresses the shortcomings of the art by providing a protective frame or case for enclosing and protecting sporting equipment, such as a golf bag with golf clubs.

In accordance with the present application, an apparatus or case for protecting a golf bag or other equipment is provided that includes a protective mat having a skeletal support structure that can be wrapped around the golf bag or other equipment to protect the golf bag or equipment during travel. The apparatus is configured to conveniently fit into a duffel or travel bag for transport, and also to be rolled up into a narrowed, spiral configuration for storage when it is not in use.

In accordance with a first aspect of the present application, an apparatus for enclosing and protecting an article is provided. The apparatus comprises a mat comprising: an inner surface and an outer surface; a first lateral edge and a second lateral edge that are opposite from each other and perpendicular to top and bottom edges; and a plurality of elongated support rods disposed in between and substantially parallel to the first lateral edge and second lateral edge. The mat is configured to be convertible between a first flattened configuration configured to receive the article on the inner surface of the mat; a second tubular configuration configured to encase the article within the mat; and a third spiral configuration, in which the mat is rolled into an elongated arrangement having a spiral cross-section. The apparatus further comprises a cap configured to cover an open end of the mat in the tubular configuration.

In accordance with various embodiments of the apparatus of the first aspect of the present application, the article to be enclosed and protected within the apparatus is a golf bag.

Further in accordance with various embodiments of the apparatus of the present application, the plurality of elongated support rods of the apparatus are disposed in between the inner surface and the outer surface of the mat.

In further additional or alternative embodiments of the apparatus of the first aspect of the present application, the mat may further comprise a plurality of pockets arranged on the inner surface of the mat, each of which is configured to receive and enclose one of the plurality of support rods.

In accordance with various embodiments of the apparatus of the first aspect of the present application, the mat comprises a plurality of panels including at least one static panel made from a first material, and at least one expandable panel made from a second material, wherein the second material is more elastic than the first material. In further such embodiments, the mat comprises a plurality of static panels and a plurality of expandable panels. Further in such embodiments, a cross-sectional diameter of the tubular configuration of the mat is expandable in dependence upon the diameter of the article encased therein.

In accordance with embodiments that may be in addition or alternative to the above-described embodiments of the apparatus of the first aspect of the application, the mat further comprises a plurality of connectors having interacting connecting elements disposed on the mat configured to lock the mat into the second, tubular configuration to encase the article. In certain embodiments, each of the plurality of connectors comprises a first connecting element arranged at the first lateral edge of the mat, and a second connecting element arranged at the second lateral edge of the mat opposite the first connecting element, the second connecting element configured to engage the first connecting element. The mat can be converted from the first flattened configuration to the second tubular configuration by bringing together the first lateral edge and the second lateral edge, and engaging the first and second connecting elements of the plurality of connectors. Each of the first connecting elements may comprise one or more rings, and each of the second connecting elements may comprise a strap including two adjacent sections that have corresponding connecting elements; and the straps of each of the second connecting elements are configured to pass through the one or more rings of each of the first connecting elements, and be folded over so that the two adjacent sections of the straps engage each other via the corresponding connecting elements. The two adjacent sections of each of the straps of the second connecting elements may comprise corresponding hook-and-loop fastener elements.

In accordance with various embodiments of the apparatus of the first aspect of the present application, the apparatus may further comprise a carrying handle disposed on the outer surface of the mat.

In certain embodiments of the apparatus of the first aspect of the present application which may be in addition or alternative to the above-described embodiments, the cap may comprise at least one locking element configured to engage a corresponding locking element on the outer surface of the mat to secure the cap into a position covering the open end of the mat in the tubular configuration. The cap may further comprise a strap having a two ends configured be secured to the outer surface of the mat, and at least one of the two ends may comprise the at least one locking element.

In accordance with a second aspect of the present application, an apparatus for enclosing and protecting an article is provided. The apparatus comprises a mat comprising: an inner surface and an outer surface; a first lateral edge and a second lateral edge that are opposite from each other and perpendicular to top and bottom edges; and a plurality of elongated support rods disposed in between and substantially parallel to the first lateral edge and second lateral edge. The mat is configured to be convertible between a first flattened configuration configured to receive the article on the inner surface of the mat; a second tubular configuration configured to encase the article within the mat; and a third spiral configuration, in which the mat is rolled into an elongated arrangement having a spiral cross-section.

Further in accordance with various embodiments of the apparatus of the second aspect of the present application, the plurality of elongated support rods of the apparatus are disposed in between the inner surface and the outer surface of the mat.

In accordance with various embodiments of the apparatus of the second aspect of the present application, the mat comprises a plurality of panels including at least one static panel made from a first material, and at least one expandable panel made from a second material, wherein the second material is more elastic than the first material. In further such embodiments, the mat comprises a plurality of static panels and a plurality of expandable panels. Further in such embodiments, a cross-sectional diameter of the tubular configuration of the mat is expandable in dependence upon the diameter of the article encased therein.

DETAILED DESCRIPTION OF THE FIGURES

Figure 1A:
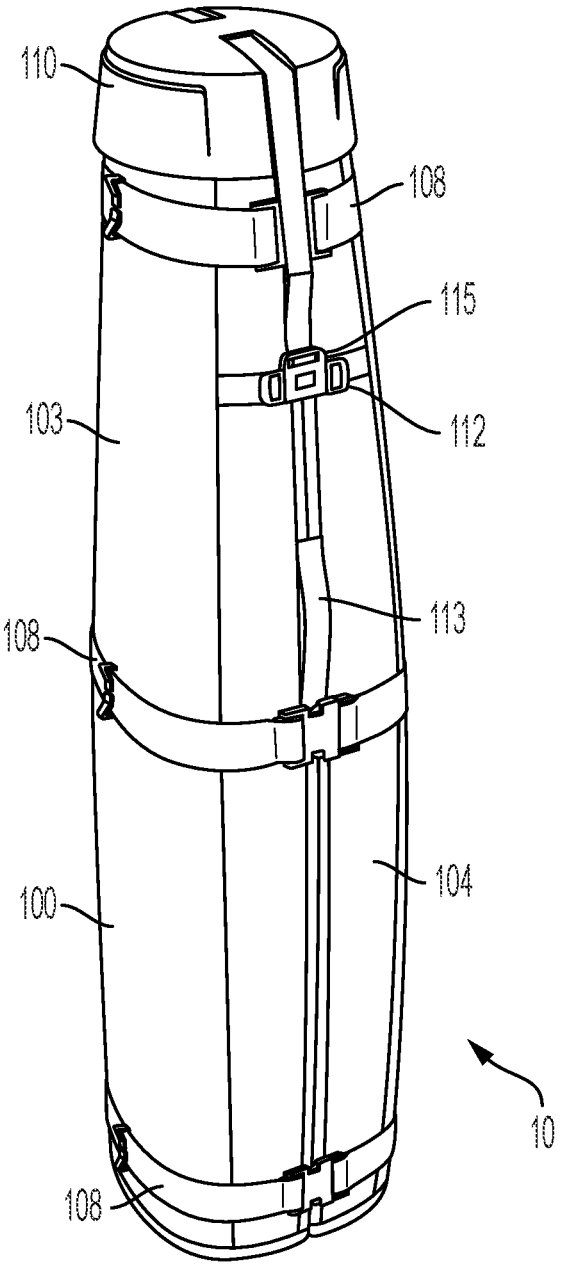
FIG. 1A shows a perspective view of an apparatus according to a first embodiment of the present application.
Figure 1B:
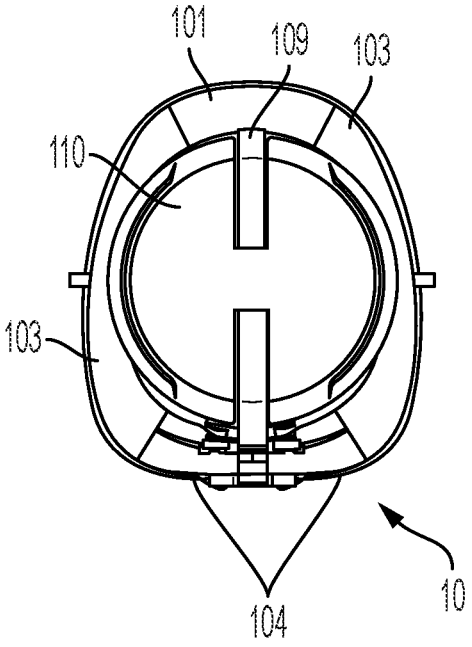
FIG. 1B shows a top view of the apparatus according to the first embodiment of the present application.
Figure 1E:
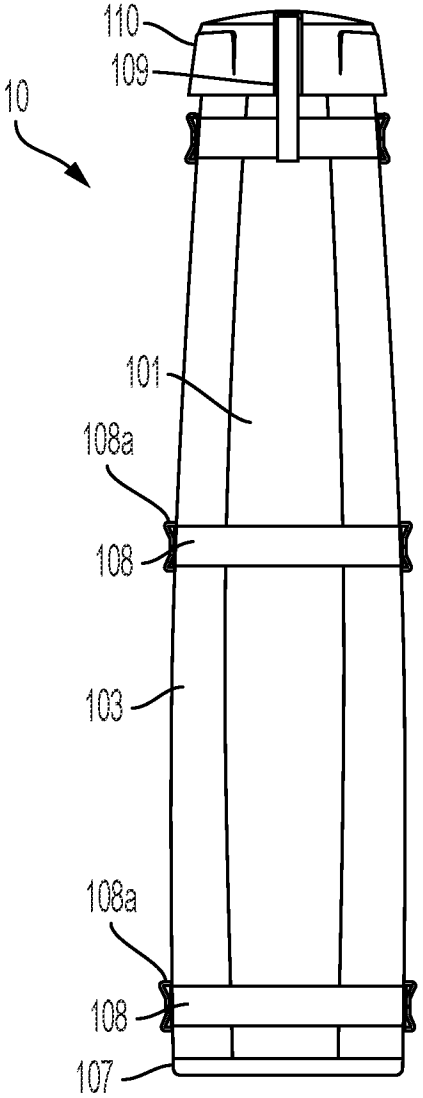
FIG. 1E shows a rear view of the apparatus according to the first embodiment of the present application.
Figure 1D:
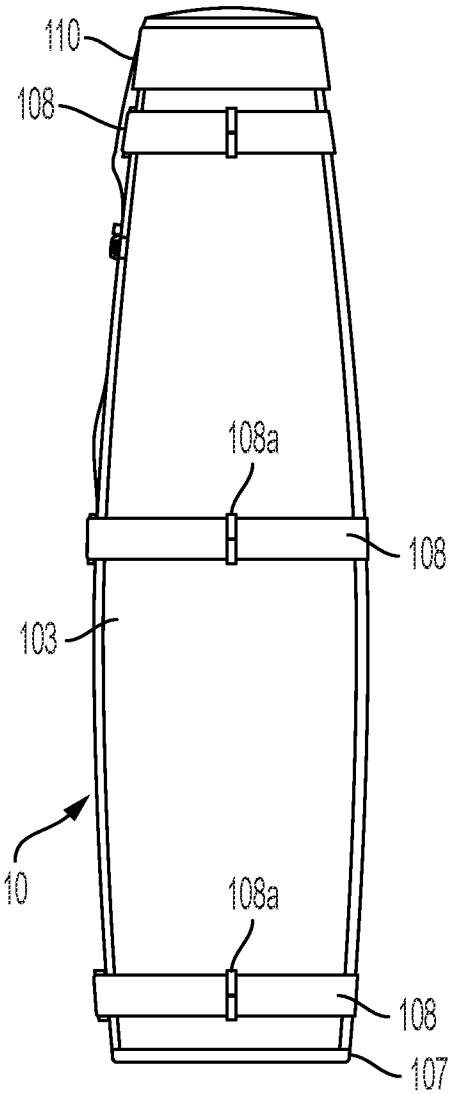
FIG. 1D shows a side view of the apparatus according to the first embodiment of the present application.
Figure 1C:
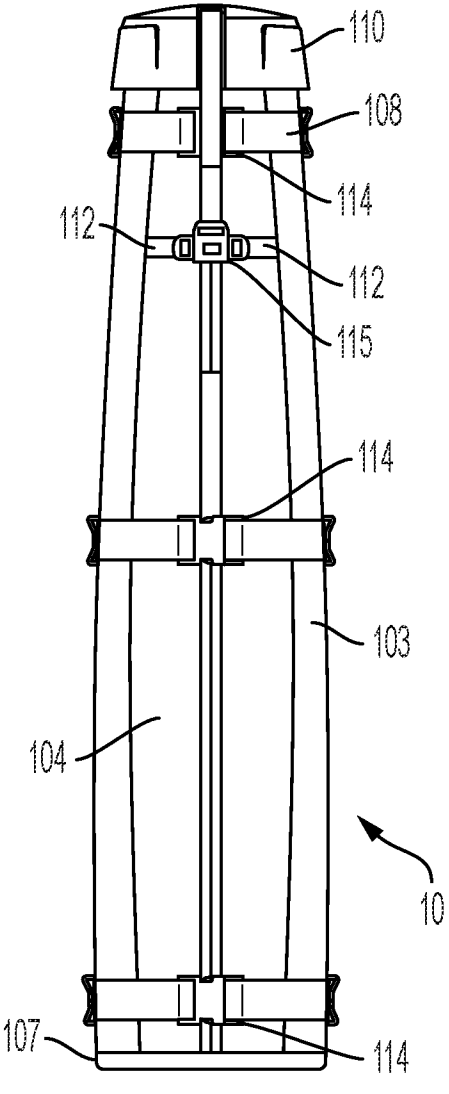
FIG. 1C shows a front view of the apparatus according to the first embodiment of the present application.

The present application will be described with reference to FIGS. 1A-10C.

In accordance with the present application, an apparatus 10 is provided that is configured to enclose and protect equipment during travel. In the embodiments illustrated in the Figures, the apparatus 10 is configured to protect golf clubs in a golf bag 200 from damage by providing a protective structure encasing the golf bag 200, including around the shafts and club heads of the golf clubs in the golf bag 200. However, the apparatus 10 of the present invention is not limited to such use, and can be configured or utilized to protect other equipment or objects, including but not limited to tennis equipment, fishing equipment such as fishing rods, and skiing equipment, or industrial products.

The apparatus 10 takes the form of a foldable case, into which a golf bag 200 can be inserted, and which wraps around and protects the golf bag 200. The case 10 includes a mat 100, which includes an internal skeleton formed by an array of rods 102, and can be rolled and unrolled so as to be able to receive the golf bag 200 in an open and flat configuration, and wrap around and enclose the golf bag 200 in a tubular or substantially cylindrical configuration, and also to be rolled up when not in use into a thinner, spiraled storage configuration. The mat 100 may include multiple layers of fabric or other material, having vertical support rods 102 arranged and secured therein to provide a rigid, casing structure around the golf bag 200. The mat 100 of the case 10 may also be flexible and elastic, in whole or in part, such that the case 10 can be expandable for use with golf bags 200 or other equipment of varying diameter.

Figure 2A:
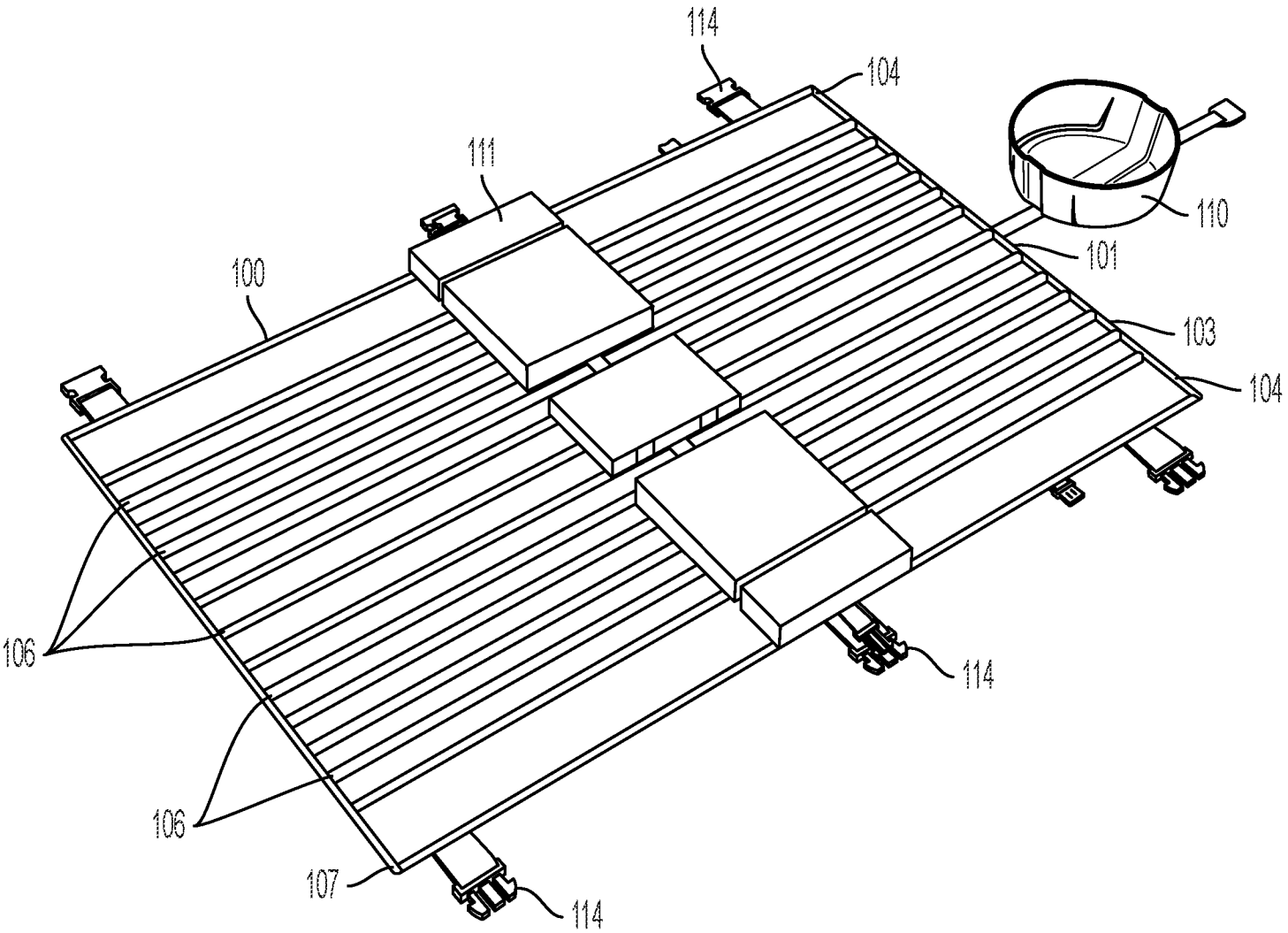
FIGS. 2A-2F show a process for using the apparatus of the present application in combination with a golf bag.
Figure 2B:
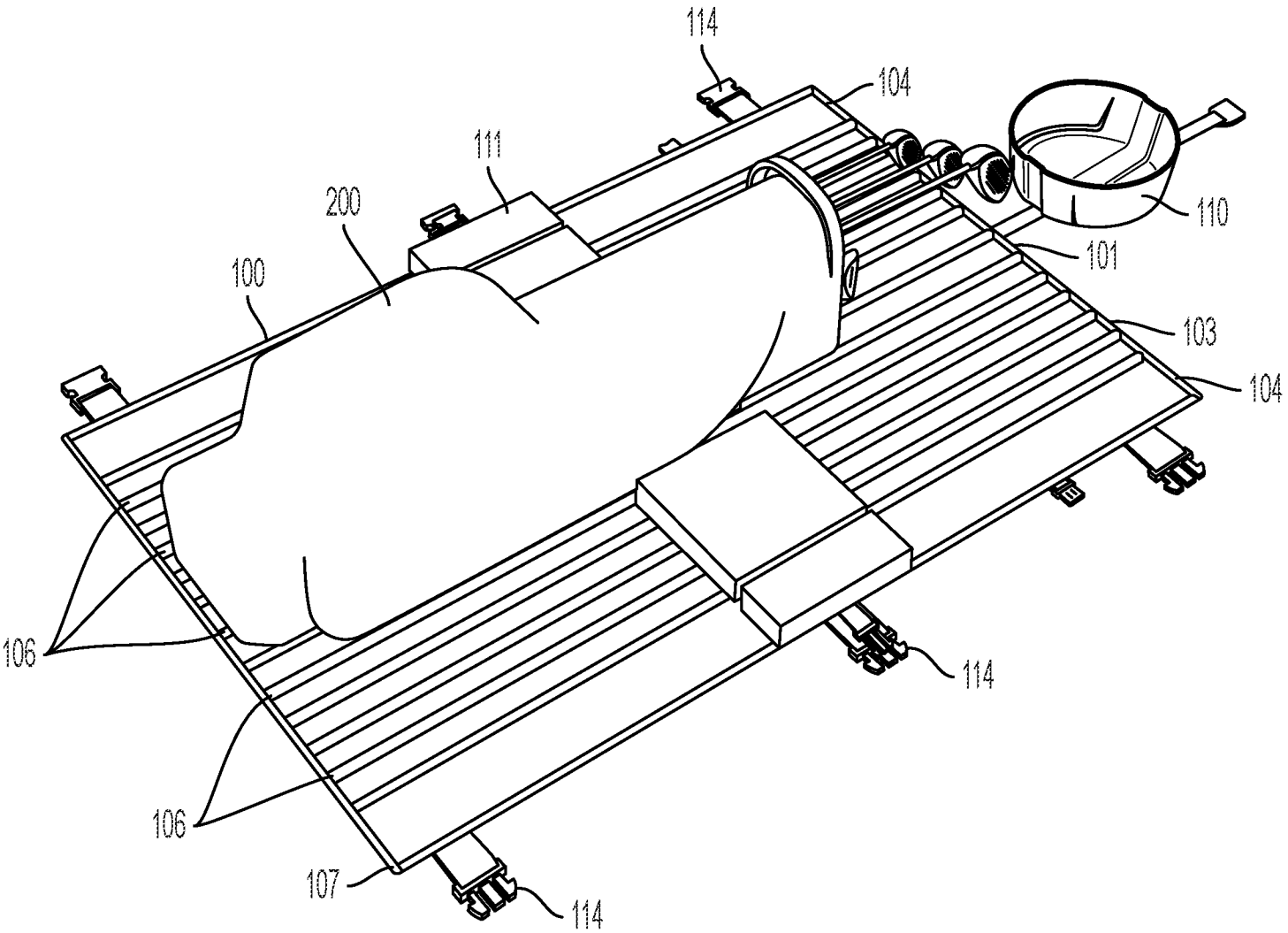
Figure 2C:
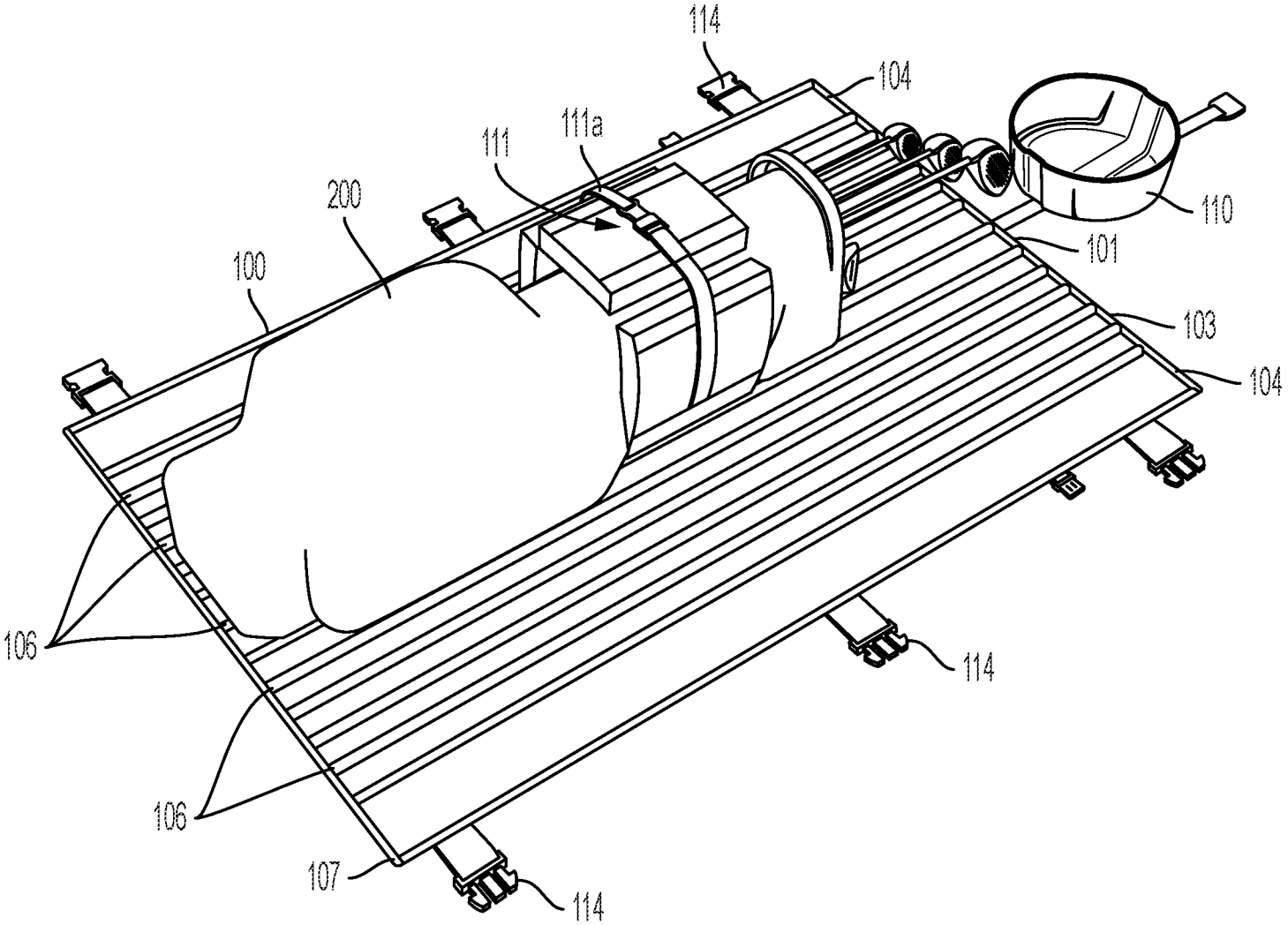
Figure 2D:
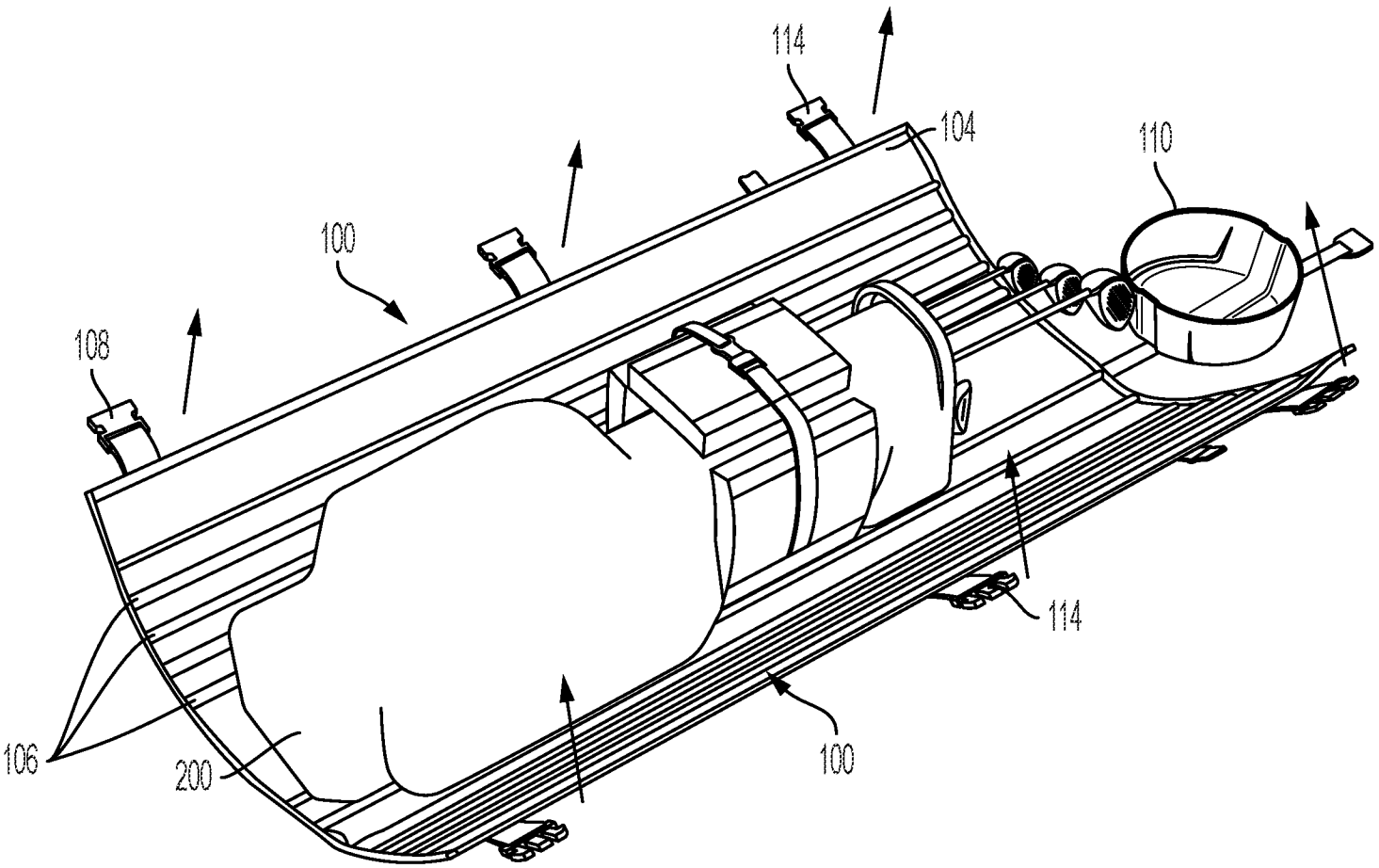
Figure 2E:
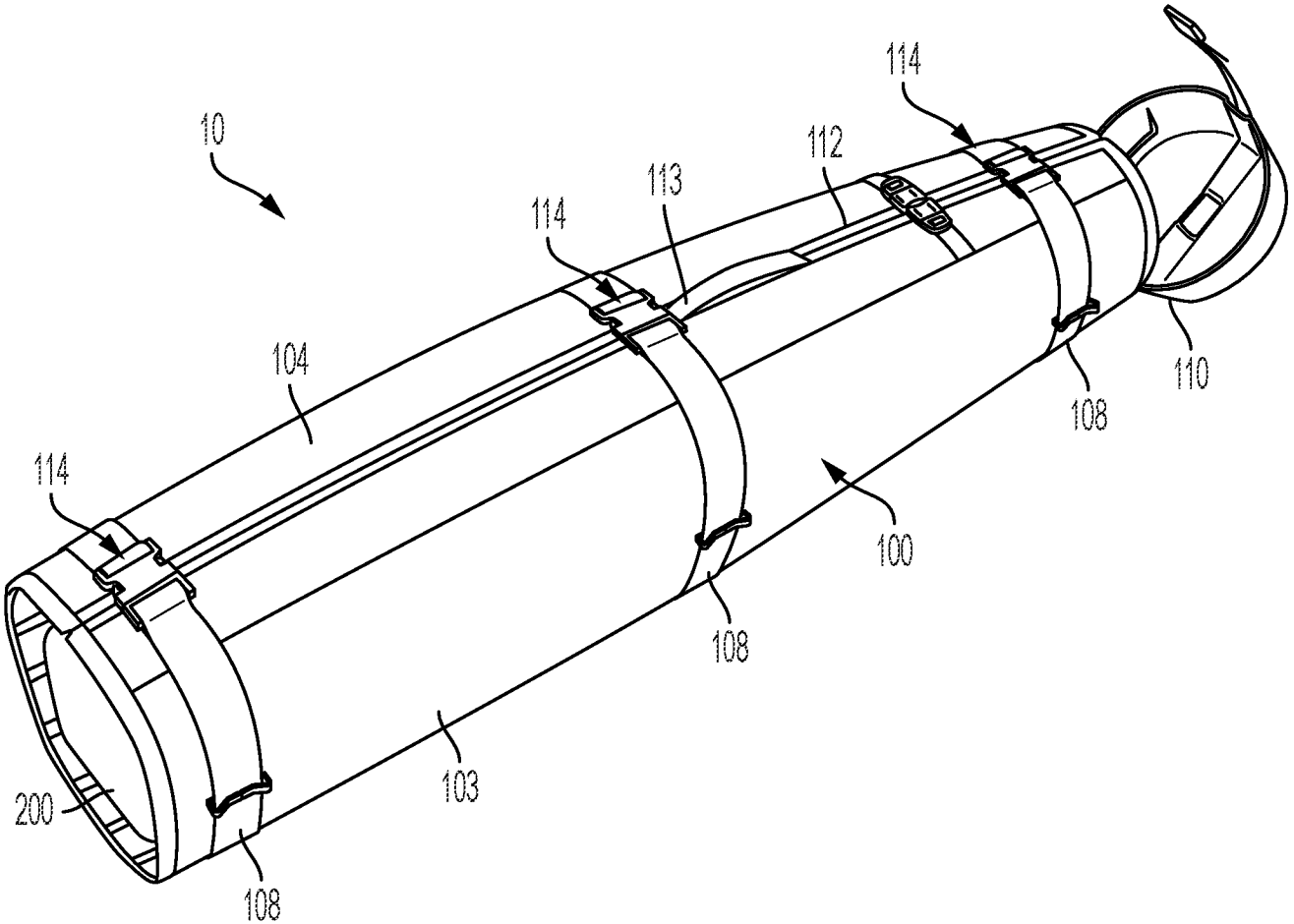
Figure 2F:
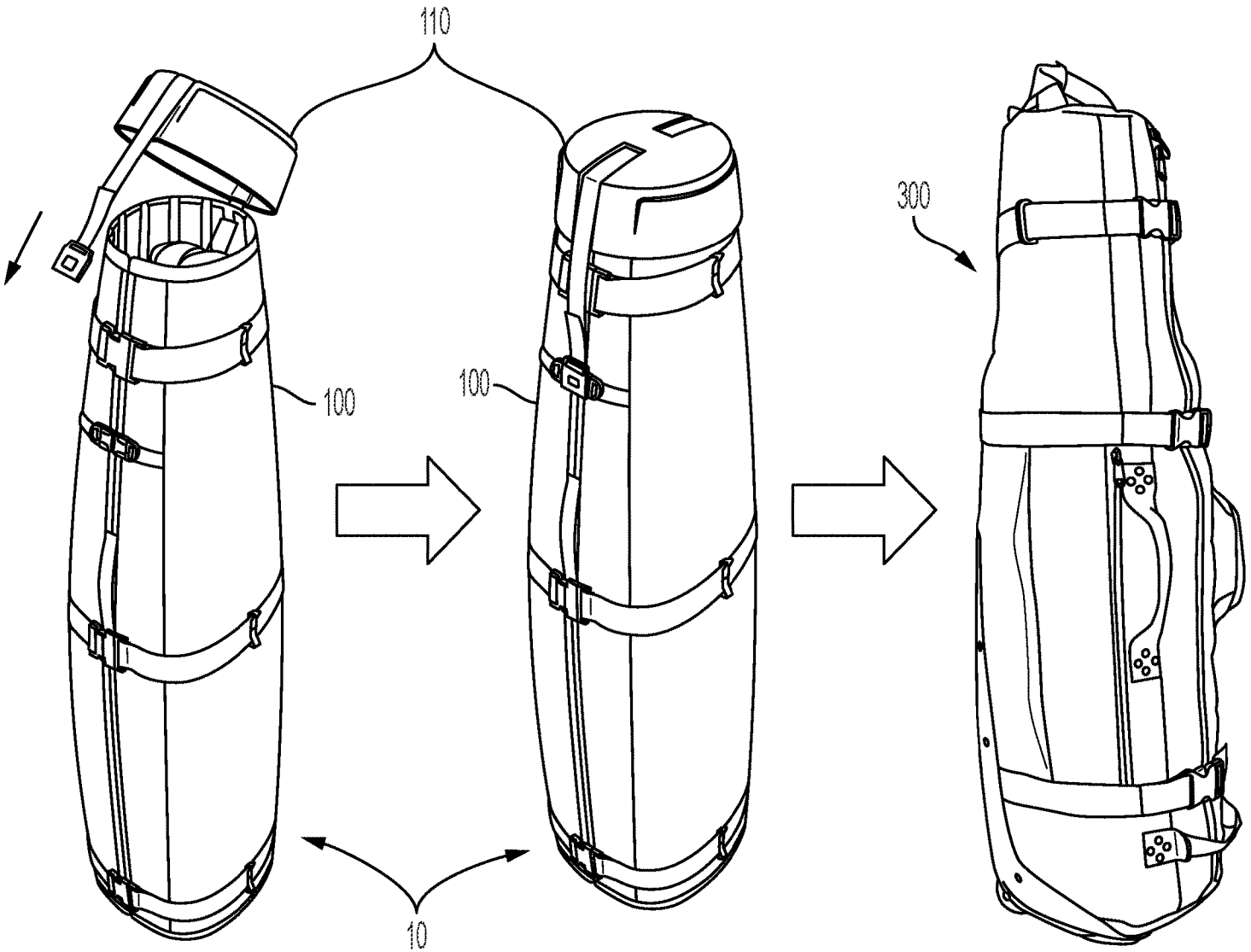

An example of a process for using the apparatus 10 to enclose a golf bag 200 with golf clubs is shown in FIGS. 2A-2F. The mat 100 can be unrolled and laid on a flat surface (FIG. 2A). The golf bag 200 can be placed in the center of the mat 100. In certain embodiments, a central segment of the mat 100 may have inner padding 111 upon which the bag 200 can be placed (FIG. 2B). In the example shown in the Figures, the golf bag 200 is arranged with any large pockets of the bag 200 facing up (i.e., away from the mat 100). If included, the inner padding 111 is folded around the golf bag 200, preferably above the large pocket area of the golf bag 200, and connectors of padding straps 111*a* (such as male and female buckle ends) on the inner padding 111 are secured together, and the inner padding strap 111*a* can be pulled to tighten the inner padding 111 around the golf bag 200 (FIG. 2C). Other embodiments of the apparatus 10 can be provided without the inner padding 111 entirely, as shown for example in FIGS. 10A-10B. Each side of the mat 100 can then be lifted or folded inward, to wrap the mat 100 around the golf bag 200 (FIG. 2D). In certain embodiments, the inner padding 111 can be secured to the mat 100 of the case along the length of the padding 111, such that the steps illustrated in FIGS. 2C and 2D occur simultaneously. In yet another embodiment, the inner padding 111 could be removably attached to the inner side of the mat 100 as to allow re-positioning or removal of the inner padding 111 for varying golf bag geometries. The connectors 114 on each end of the outer straps 108 (such as male and female buckles, hook-and-loop fasteners, buttons, tabs or other connecting elements) are secured together and the straps 108 can be pulled to tighten the mat 100 wrapped around the golf bag 200 (FIG. 2E). The cap 110 of the apparatus 10 can be flipped to cover the top of the golf bag 200 and is secured in position by inserting two buckle ends 112 on the outside of the mat 100 to a three-way buckle 115 at the end of the strap 109 on the cap 110 (FIG. 2F). The apparatus 10 with golf bag 200 secured therein can then be inserted into a further bag 300 for traveling (FIG. 2F).

Figure 3:
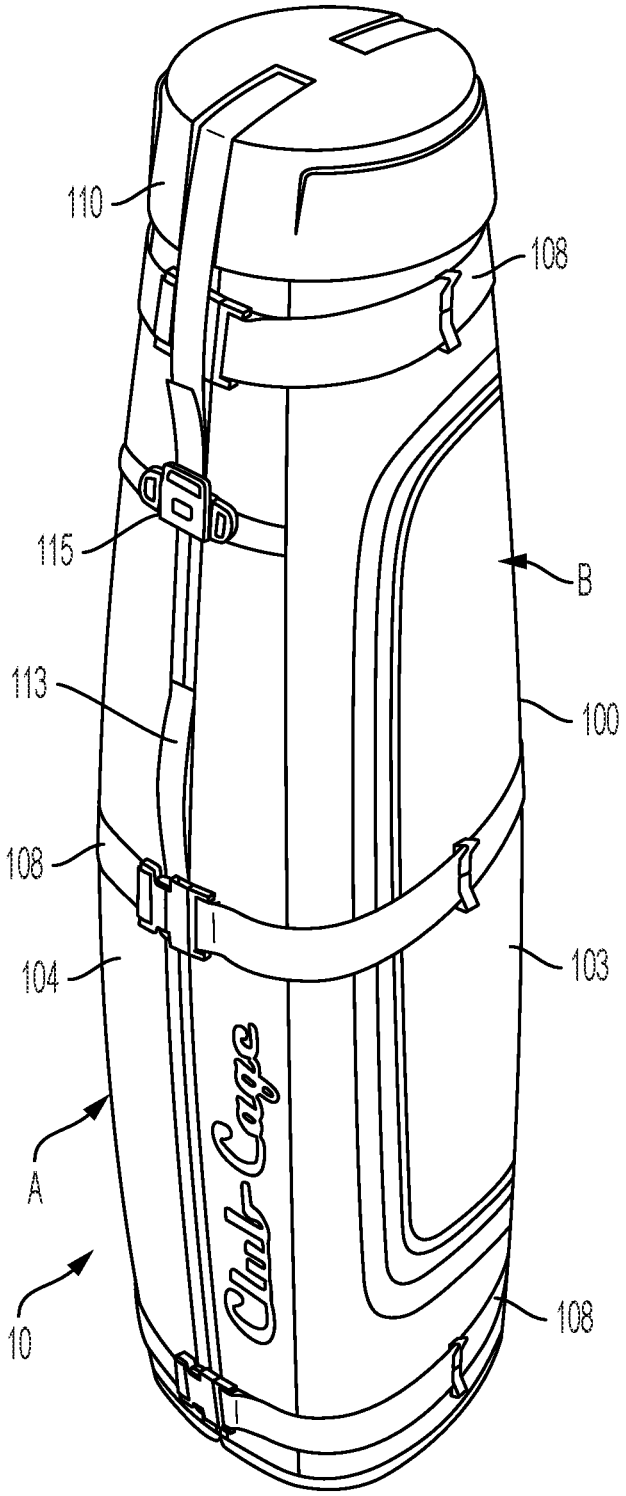
FIG. 3 shows a further view of the apparatus according to an embodiment of the present application.

The apparatus 10 of the present application can be made from any number of different materials. In embodiments of the apparatus 10, the mat 100 of the apparatus 10 includes multiple panels 101, 103, 104, which can each be made from different materials having different properties. For example, the mat 100 may comprise static panels 101, 104 (illustrated in dark gray in the Figures) that are configured to be inelastic, or less elastic than other panels. These inelastic panels 101, 104 can be made from a first fabric material A, including for example a ballistic nylon or CORDURA™ fabric including a nylon blend, or another similar material, which provides a stable, non-elastic foundation for stitching the straps 108 thereto. Other, more elastic panels 103 of the mat 100 (illustrated in lighter gray in the Figures), can be made from a second fabric material B, that is more flexible or stretchable, such as an elastane or LYCRA™ type fabric. The fabric B provides a generous level of elasticity to conform around most sizes of walking-style and some sizes of stand-type golf bags and inconsistent features golf bags may possess (e.g., various pockets and other accessories in the golf bags). The cap 110 of the apparatus 10 can be made from a fabric such as a ballistic nylon or CORDURA™ similar to the inelastic panels 101, 104, which may or may not include a rigid disk disposed between layers of fabric at the top, or may also be made from a different material than the mat 100, such as a rigid plastic material. In alternative embodiments of the apparatus 10, the apparatus 10 can be made from other materials, and each of the panels 101, 103, 104 and/or cap 110 can be made from the same material(s). The mat 100 may also have design elements or text included thereon, such as by silk-screening, as shown in FIG. 3 for example, which is branded with the trademark CLUB CAGE and other design elements.

Figure 5:
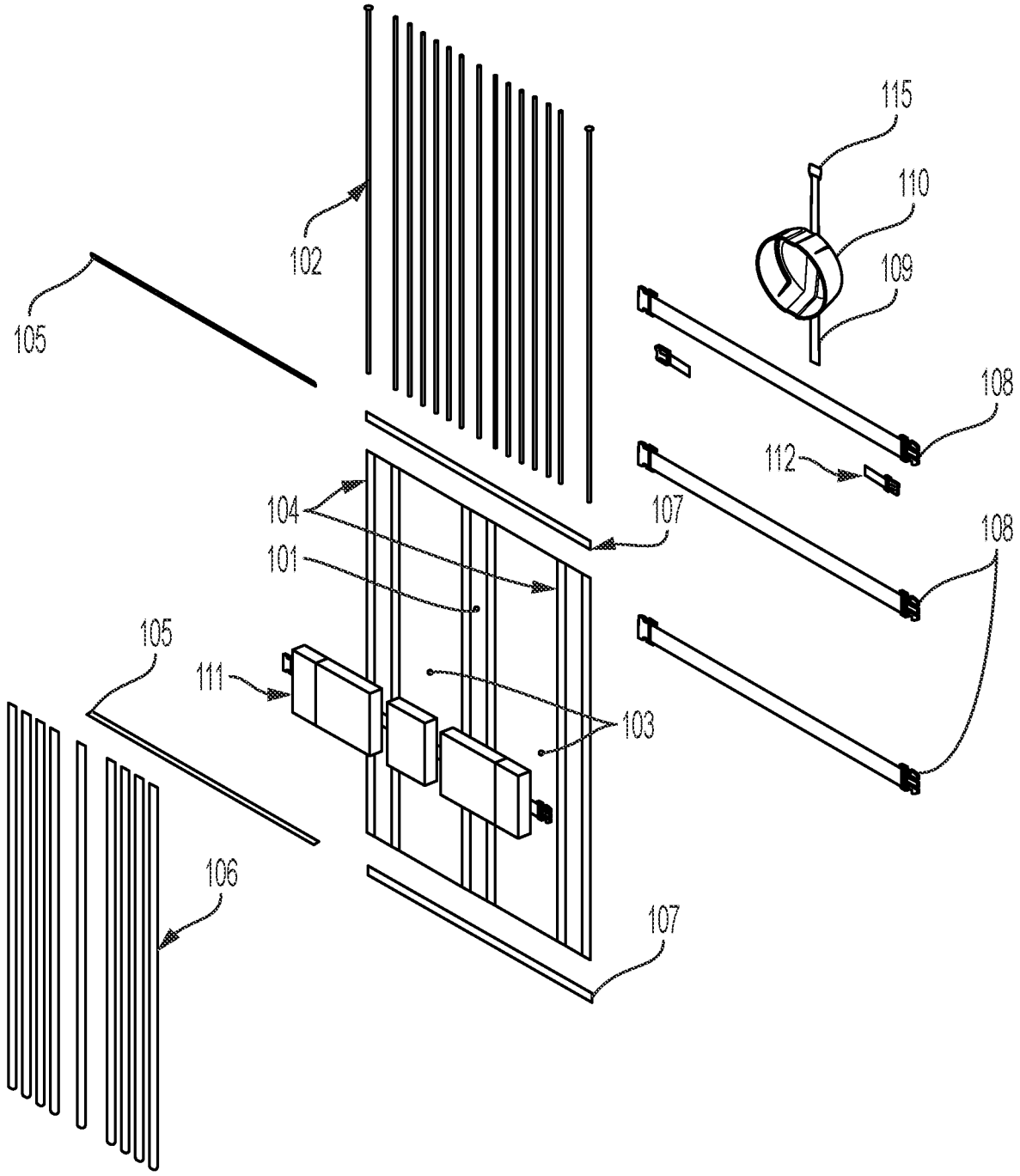
FIG. 5 shows an exploded view of the apparatus according to an embodiment of the present application.

FIG. 5 shows an exploded view of the apparatus 10 according to an embodiment of the present application, and the various elements of the apparatus 10.

Figure 4:
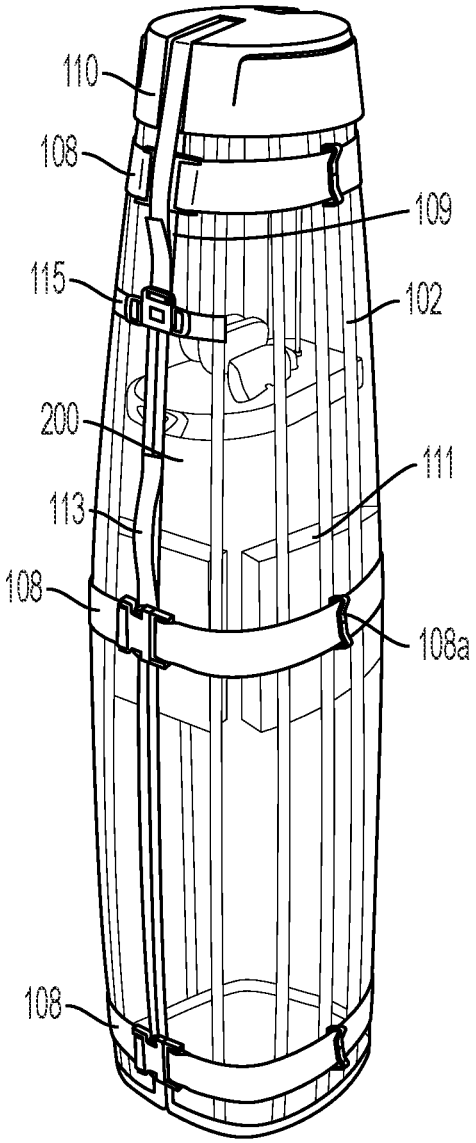
FIG. 4 shows a partially transparent view of the apparatus according to an embodiment of the present application.

A rear static panel 101 can be made of a first material such as fabric/material A described above. Center sections of straps 108 can be sewn onto the rear static panel 101 to secure the straps to the mat 100 of the apparatus 10, or the straps 108 can be affixed, permanently or removably, to the rear static panel 101 in any other suitable manner. Expandable panels 103 are provided on each side of the rear static panel 101, and can be connected to the rear static panel 101 by sewing or any other suitable means of affixing the panels 101, 103 together. The expandable panels 103 are made from a more flexible material, such as fabric/material B discussed above, so that the perimeter or cross-sectional diameter of the apparatus 10 can be expanded when encasing an object if necessary to accommodate objects of different sizes. The mat 100 of the apparatus 10 also includes front static panels 104 along each lateral edge of the expandable panel 103 not affixed to the rear static panel 101, by sewing or any other suitable means of affixing the panels 103, 104 together. The front static panels 104 can be made of the same or similar materials as the rear static panel 101. At least one of the front static panels 104 may also comprise one or more carrying handles 113 affixed thereon, to aid in carrying the apparatus 10, as shown in FIG. 4.

A plurality of insert rods 102 are provided, which create a rigid protective skeletal structure around the golf bag 200 or other equipment. In the example embodiment shown in FIG. 5, fifteen rods 102 are included, each having a length of 47 inches, but the number of rods and their respective length may vary in other embodiments of the apparatus 10. The rods 102 can be made of pultruded fiberglass, or any other suitable rigid material, such as a plastic or a metal composition.

Each elongated edge of the front and rear static panels 101, 104 may have a pocket or other receptacle along its length for receiving and securing one of the insert rods 102 to the apparatus 10. The pockets on the front and rear panels 101, 104, can be closed on each of four sides, such as by seams, once an insert rod 102 is inserted into the pocket. In the example shown in FIG. 5, the static panels 101, 104 include six total pockets (two on each panel). A plurality of pocket strips 106 are also provided, which can be sewn onto the panels 101, 103, 104 along their length and also receive support rod 102. In the embodiment shown in FIG. 5, nine pocket strips 106 are provided, each of which receives and houses a support rod 102 and is closed on each of its four sides. Alternatively, pockets can be formed by folds or creases in one layer of material forming a panel 101, 103, 104 being sewn to a second layer of material. In other embodiments of the apparatus 10, the number of rods 102 and pockets can vary from the fifteen rods and pockets shown in FIG. 5.

An edge band strip 107 having an edge band insert 105 is provided along the top and bottom of the mat 100, across the tops and bottoms of the panels 101, 103, 104, which can protect the tops and bottoms of the panels 101, 103, 104 from damage or fraying. The edge band strip 107 can be made from a material similar to that of the static panels 101, 104, whereas the insert 105 can be made of another material, such as polyurethane rubber.

Straps 108, having connectors 114 on each end, are provided that are affixed to the rear static panel 101 as previously described. In the embodiment illustrated in FIG. 5, three straps 108 are provided on the top, middle and bottom of the mat 100, each having a width of approximately two inches, but more or fewer straps 108, or straps 108 of a different width, can be used in other embodiments. One end of each strap 108 has a connector 114 (such as a male buckle or a hook and loop fastener) and the opposite end of the strap 108 has a corresponding connector 114 (such as a corresponding female buckle configured to engage the male buckle or a corresponding hook and loop fastener), so that the two ends of the strap 108 are secured together when the apparatus 10 encases an article 200. Alternative connectors 114 can be utilized other than corresponding male and female buckle ends. For example, in one embodiment, the connectors may include one more rings or loops configured to receive an element through the ring(s) that may fold back upon or connect to itself, including for example a strap having both parts of a hook-and-loop fastener disposed thereon that may pass through the loop and fold upon itself to secure the hook-and-loop fastener, as shown for example in FIGS. 10A-10B. Alternatively, a clip or clasp can be provided as the other connecting element to engage the ring or loop. Further examples of connectors may also include corresponding ends of a snap fit or button engagement, corresponding engaging magnetic elements, corresponding hook-and-loop fastening elements, strings or ropes configured to be tied, corresponding tabs and receiving elements, or any other suitable mechanism for securely connecting the two ends of a strap. In further alternative embodiments, the connectors 114 can be disposed directly on the lateral edges of the mat 100 on the mat inner or outer surface without straps 108. The straps 108 and connectors 114 can be made of nylon or any other material known in the art for such suitable purpose. As shown for example in FIG. 4, one or more keepers 108*a* or slots may be provided on the outer surface of the mat 100, which the straps 108 can pass through, to aid in stabilizing the straps 108 around the golf bag 200.

Figure 10A:
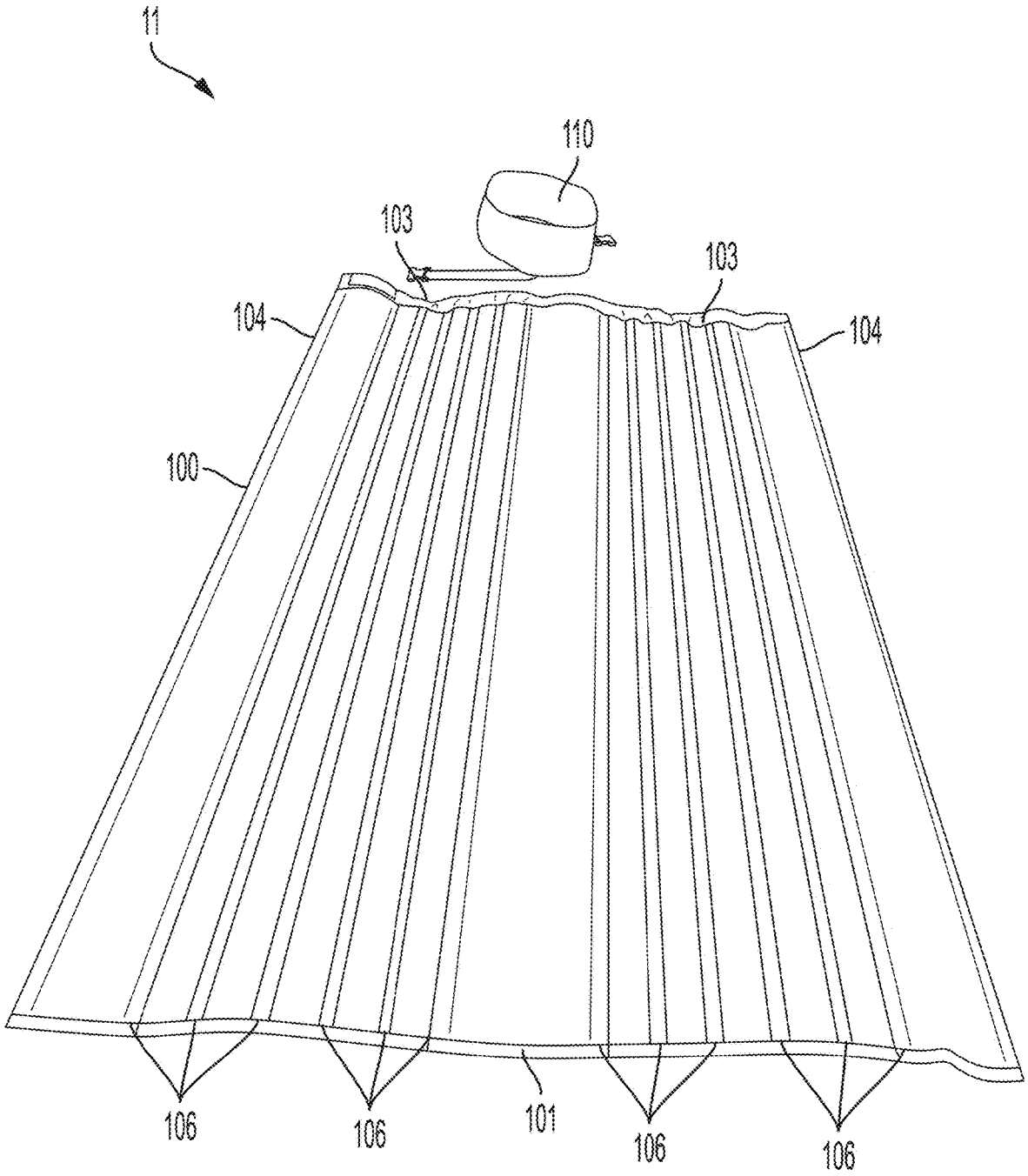
FIGS. 10A-10C show various views an apparatus according to a further embodiment of the present application.
Figure 10B:
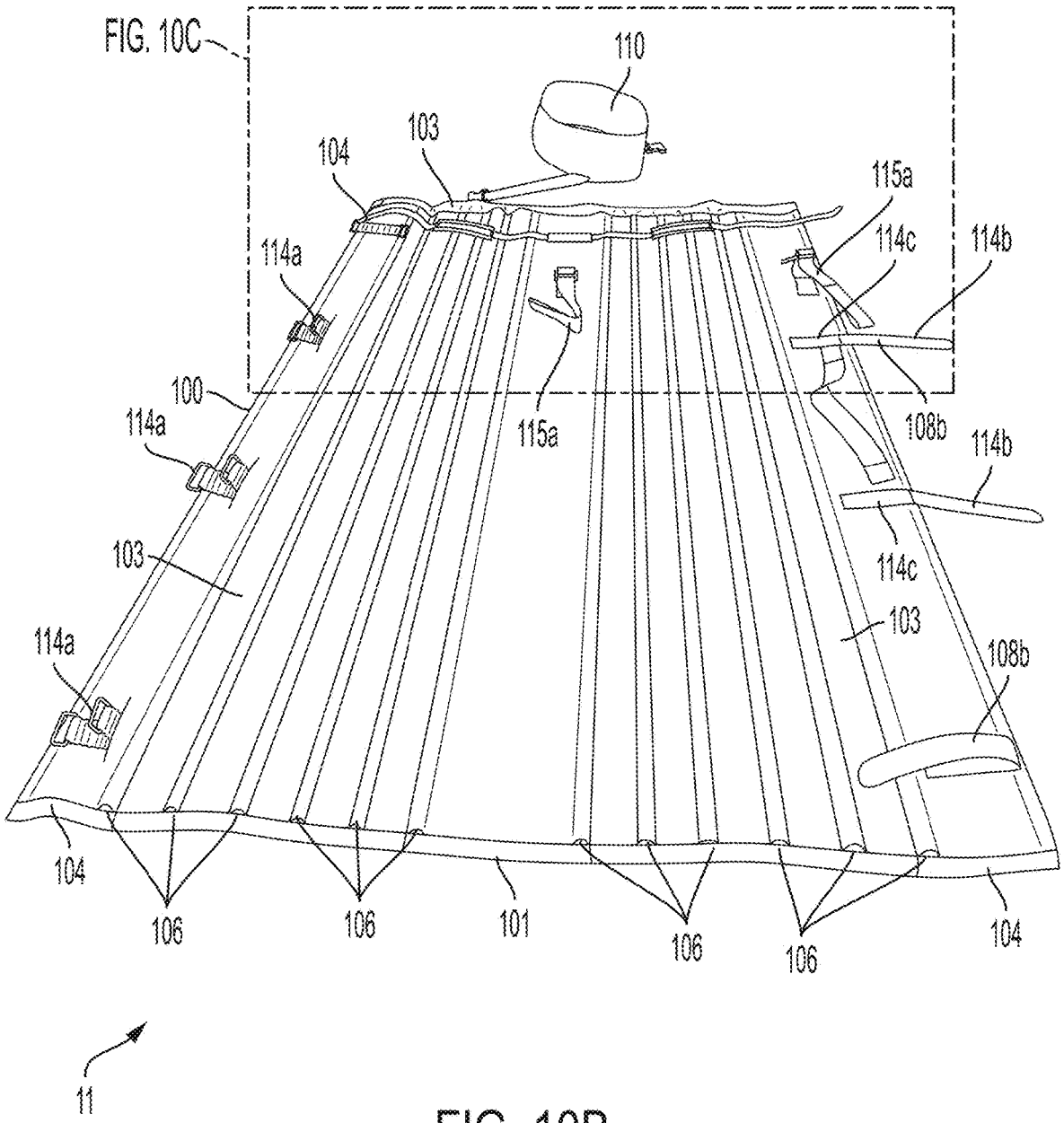

The apparatus 10 further comprises a cap 110, which is to be positioned over an open end of the mat 100 when it is rolled up in use, to provide a protective structure atop the golf bag 200. In certain embodiments, the cap 110 can be made of a rigid material, including a rigid plastic such as polycarbonate or acrylonitrile butadiene styrene (ABS) plastic. In other embodiments, such as shown in FIGS. 10A-10B, the cap may be made of a fabric material which may include a rigid disk insert between layers of fabric. A strap 109 is affixed to the cap 110 for securing the cap 110 to the mat 100. In the embodiments illustrated in the Figures, the cap 110 comprises an opening through which the strap 109 can be inserted, and the cap 110 may also include slots on the outer surface to receive the strap 109, so that the strap 109 does not slide excessively. In embodiments in which the cap 110 has a fabric material, the strap 109 can be sewn into the cap 110. In some embodiments, one end of the strap 109 can be affixed to the rear static panel 101 of the mat 100, such as by a seam, so that the cap 110 remains permanently connected to the mat 100. The other end of the strap 109 may comprise a three-way buckle 115, which has two additional slots for receiving additional buckles that are on straps 112 that are attached to each of the two front static panels 104. The buckle 115 connects to the buckles of straps 112, so that during use of the apparatus, the cap 110 is secured to the front and rear. A two-way buckle or connector may also be used as an alternative to the three way buckle or connector 115, in which only one corresponding connector element is disposed on the mat 100, as shown for example in FIGS. 10A-10B. In additional embodiments, both ends of the strap 109 can be attachable and detachable from the mat 100 using the same or similar mechanism, as also shown in FIGS. 10A-10B. Alternative connecting elements can be used in place of the buckles 112, 115, including for example corresponding ends of a snap fit or button engagement, corresponding engaging magnetic elements, corresponding hook-and-loop fastening elements, strings or ropes configured to be tied, corresponding tabs and receiving elements, or any other suitable mechanism for securely connecting the two ends of a strap, or any of the connecting elements 114 noted above. Other mechanisms for locking the cap 110 in place with respect to the mat 100 can also be provided without using a strap 109, such as snaps, buttons, tabs/slots, magnets or other interlocking components. Further, in alternative embodiments, the cap 110 may have a second removable connecting element 115 in place of a permanent affixture to the outer surface of the mat 100. In the embodiment shown in FIG. 5, the cap 110 has a substantially cylindrical shape with an open bottom to position over the golf bag 200 and top of the rolled mat 100. In other embodiments, the cap 110 can be disk shaped. A bottom cap or cover for the apparatus 10 can also be provided having a similar configuration.

In certain embodiments, inner padding 111 can also be secured to the mat 100 of the apparatus 10 to provide additional support around the golf bag 200 or other article inside the mat 100. The padding 111 can be made of polyurethane foam, or other similar materials to provide padding around the golf bag 200. The inner padding 111 may also include a strap 111*a* with connecting elements on each end, similar to the strap 108 described above, wherein the connecting elements can take the form of male and female buckles, corresponding ends of a snap fit or button engagement, corresponding engaging magnetic elements, corresponding hook-and-loop fastening elements, strings or ropes configured to be tied, corresponding tabs and receiving elements, or any other suitable mechanism for securely connecting the two ends of a strap, including those referenced above with respect to the connectors 114.

FIGS. 6-9B provide additional schematic diagrams of the apparatus discussed above.

Figure 6:
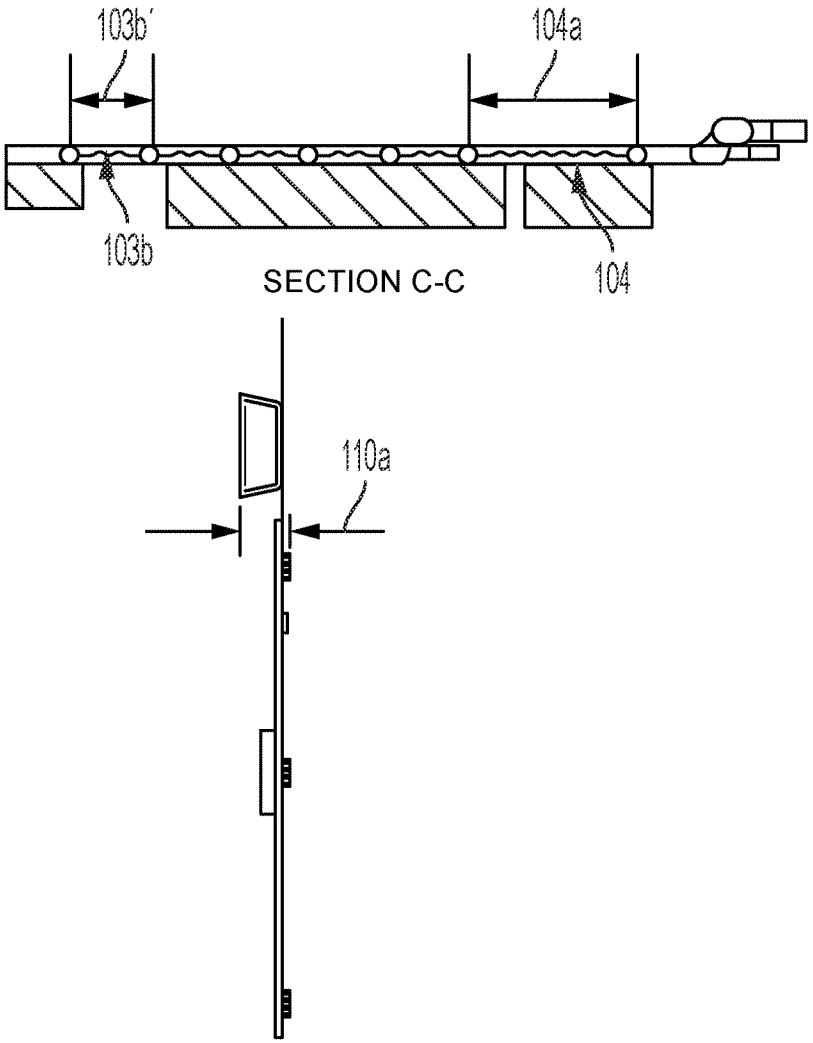
FIGS. 6-9B show various additional schematic views of the apparatus according to embodiments of the present application.
Figure 6:
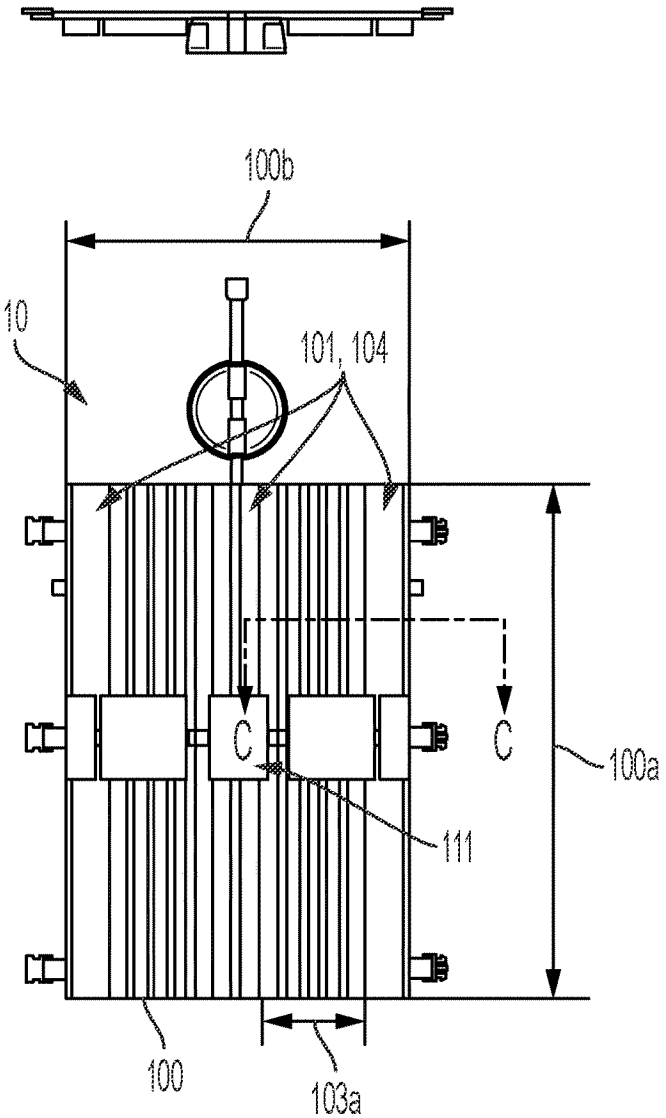

FIG. 6 illustrates various views of the apparatus with the mat 100 in the flattened, open configuration. In the embodiment illustrated, the mat may have a height 100*a* of approximately forty-nine inches. The width 100*b* of the mat may vary depending on the expansion of the elastic panels 103, which in the embodiment shown in FIG. 6 is between approximately thirty-two inches in a relaxed state and approximately forty-eight inches in an expanded state. The elastic panels 103 may have a width 103*a* of approximately 9.5 inches in a relaxed state. The elastic panels 103 also include elastic zones 103*b* in between the support rods 102 having a width 103*b*' of approximately 1.9 inches in a relaxed state. The static panels 104 may have a width 104*a* of approximately 4 inches. The cap 110 may have a height 110*a* of approximately 4.4 inches.

Figure 7:
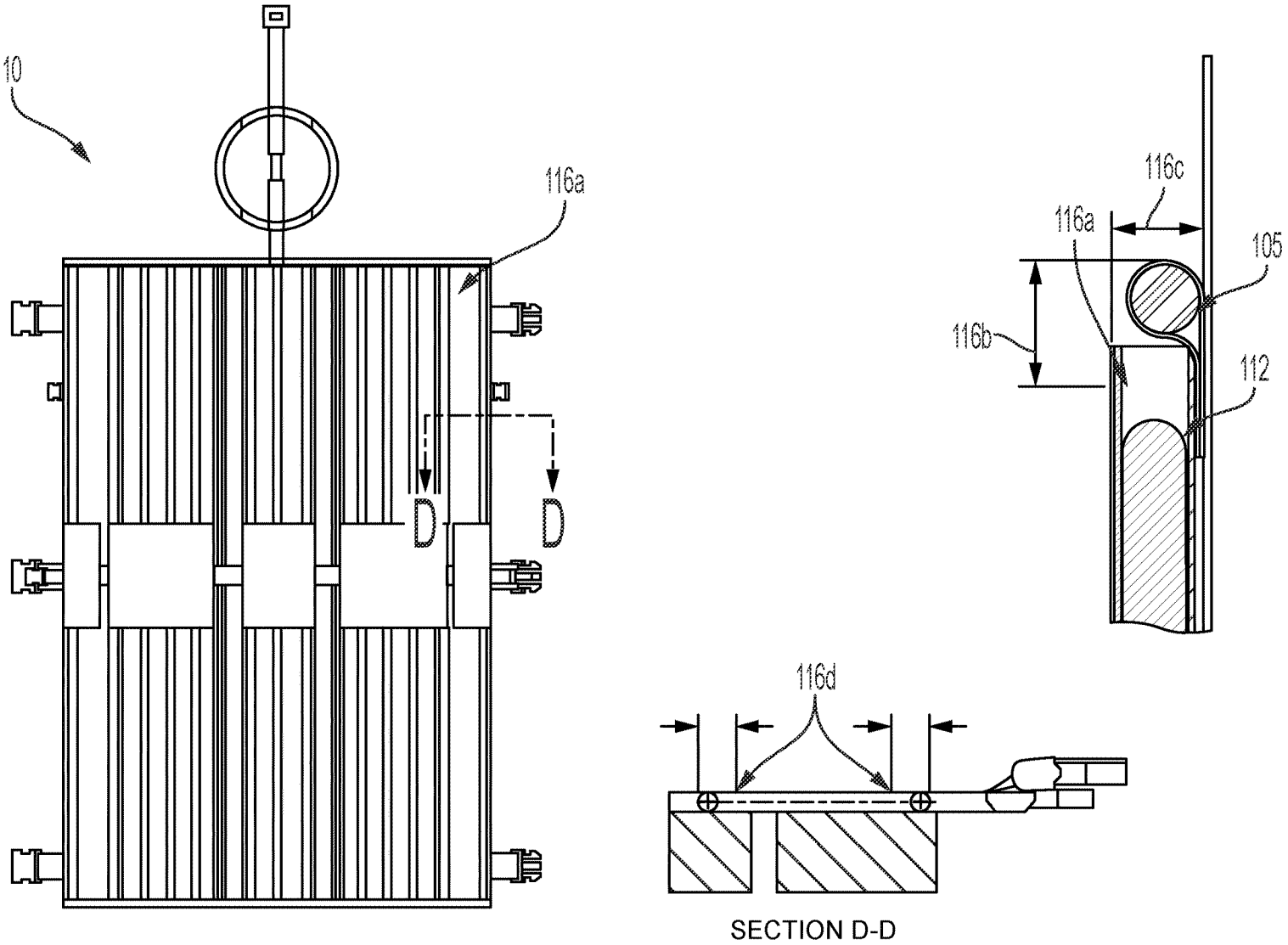

FIG. 7 illustrates various stitch lines of the apparatus 10 in accordance with an embodiment of the application. A stitch line 116*a* is provided along the top and bottom edges of the mat 100, which may enclose the rods 102 between the edge band inserts 105 and strips 107. An area 116*c* to be flattened by the stitch line may have a width of approximately 0.5 inches and a height 116*b* of approximately 0.6 inches. Stitch lines 116*d* are also provided along the lateral edges of the static panels 104, which may be a distance of approximately 0.7 inches from each of the rods 102 or the pockets for receiving rods 102.

Figure 8:
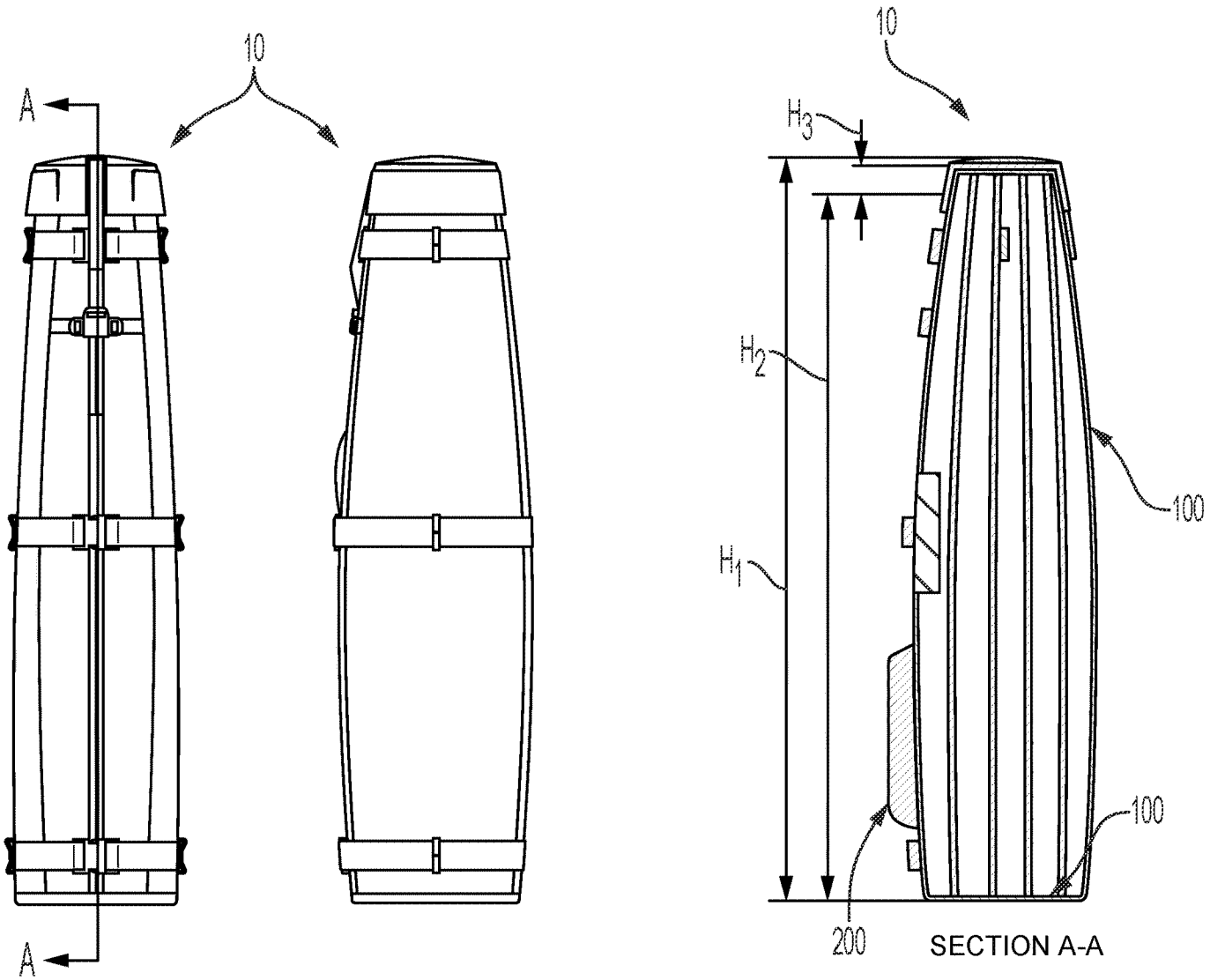

FIG. 8 illustrates various dimensions of the apparatus 10 in combination with a golf bag 200 that it is encasing. The apparatus 10 may include a maximum height $H_1$ of approximately 50.8 inches, including a mat 100 height $H_2$ of approximately 48 inches when encasing the bag 200. A clearance height $H_3$ is provided above the longest expected club of approximately 1.8 inches. The mat 100 will conform to upper and lower rigid portions of the golf bag 200 when the straps 108 are tightened, and any pockets on the golf bag 200 will be compressed by the mat 100.

Figure 9B:
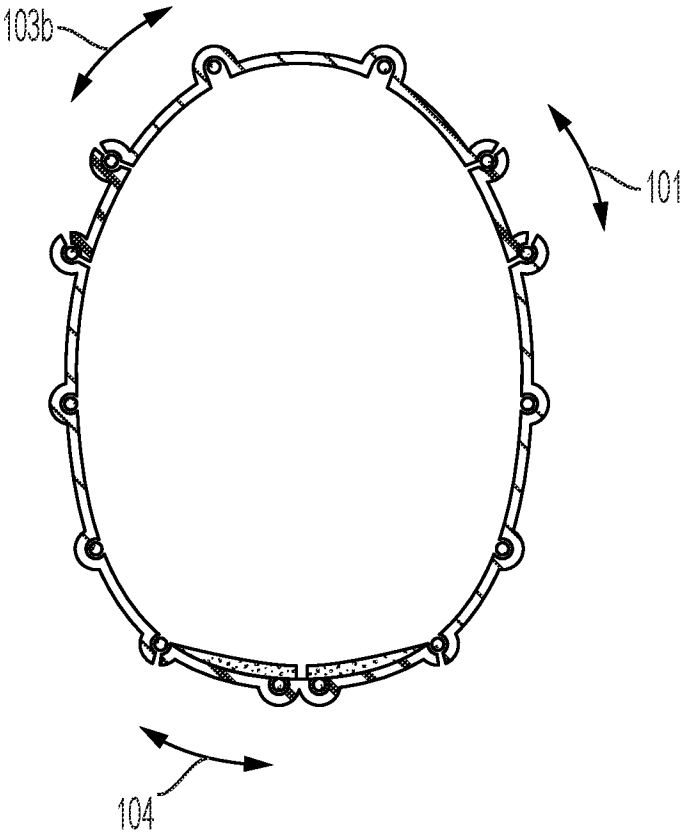
Figure 9A:
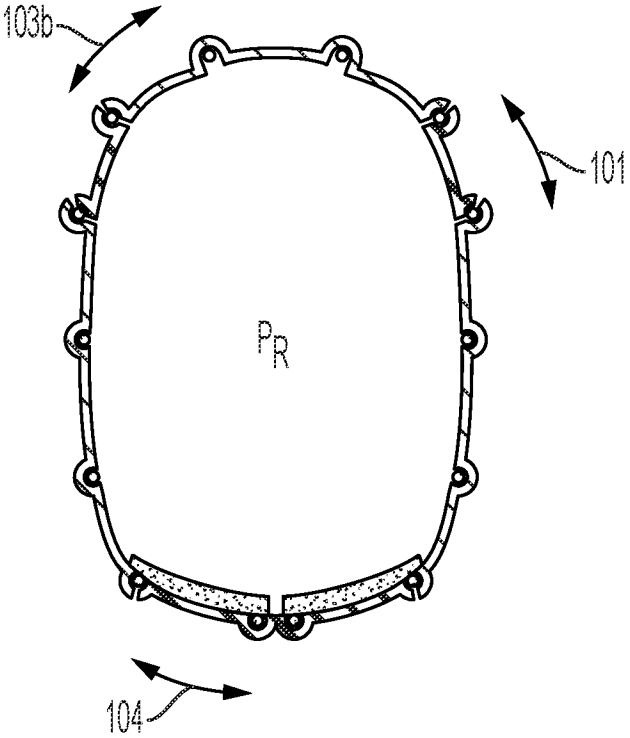

FIGS. 9A and 9B illustrate cross-sectional views of the mat 100 in its tubular configuration, as when enclosing a golf bag 200. It is noted that in the embodiment shown in FIG. 9, the rear static panel 101 is split into two rear static panels 101 with an additional elastic panel 103 arranged therebetween. FIG. 9A shows the mat 100 in a relaxed state, such as when it is not expanded to accommodate a golf bag 200 therein. The total perimeter in the relaxed state ($P_R$) may be approximately thirty-two inches, including a width of approximately 2.125 inches of each of the nine elastic zones 103*b*, a width of 2.5 inches for each of the two rear static panels 101 and a width of four inches for each of the front static panels 104. FIG. 9B shows the mat 100 in an expanded state, such as when it is expanded to accommodate a golf bag 200 therein. The total perimeter in the expanded state ($P_E$) may be approximately forty-nine inches, including an expanded width of approximately four inches of each of the nine elastic zones 103*b*, a width of 2.5 inches for each of the two rear static panels 101 and a width of four inches for each of the front static panels 104.

The dimensions of the apparatus can vary from those illustrated in the FIGS. 6-9B and discussed above without deviating from the scope of the invention.

Figure 10C:
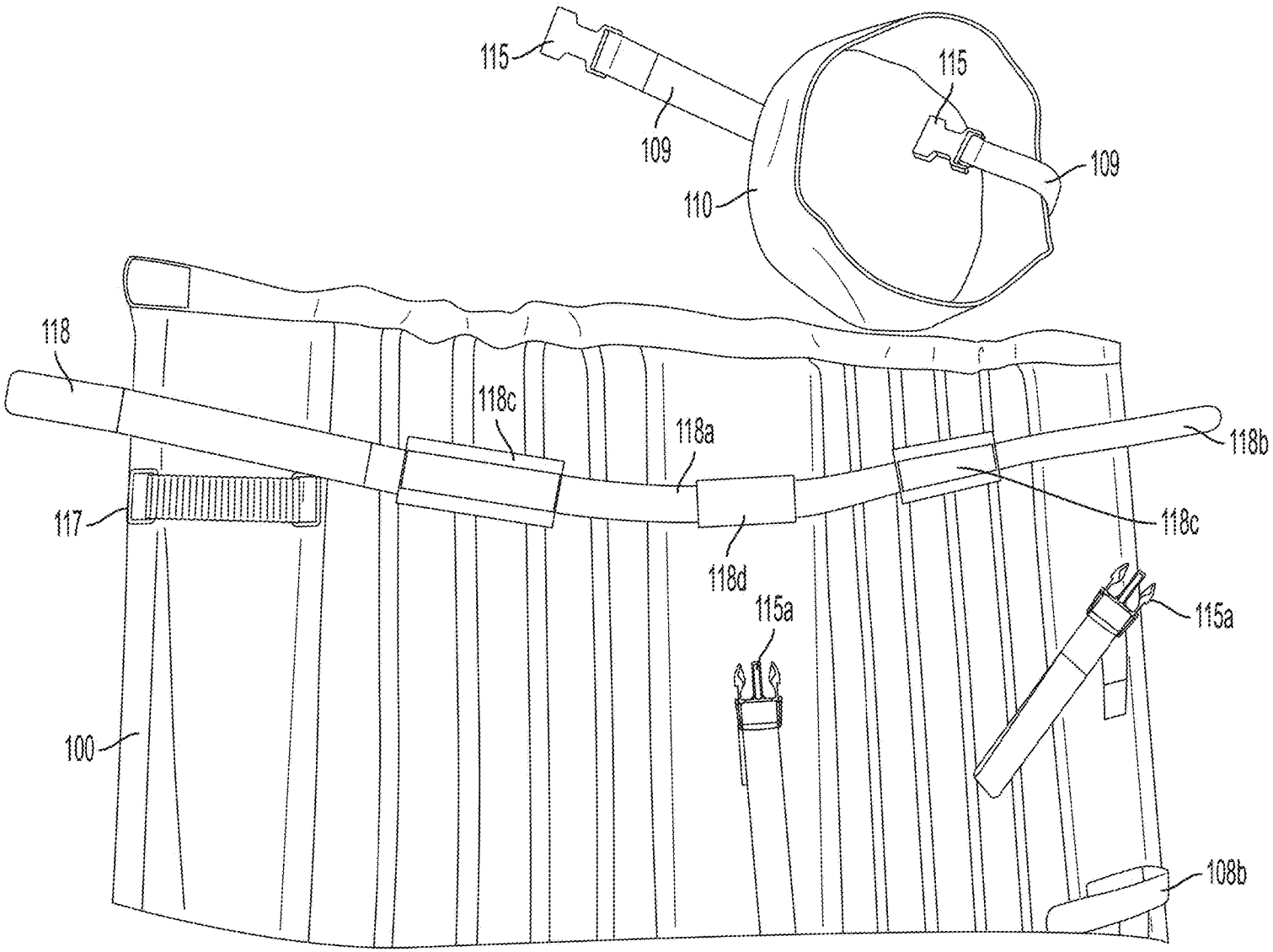

A further alternative embodiment of the apparatus 11 is shown in FIGS. 10A-10C. FIG. 10A shows the surface of the mat 100 of the apparatus 11 onto which the golf bag would be laid, which would operate as the inner surface of the mat 100 when it encases the golf bag, and FIG. 10B shows the outer surface of the mat 100 of the apparatus 11.

The apparatus 11 does not include the inner padding 111 of other embodiments of the apparatus 10. The mat 100 of the apparatus 11 includes multiple panels 101, 103, 104, including static panels 101, 104 and elastic panels 103 which can each be made from the different materials described earlier herein. The cap 110 of the apparatus 11 can be made from a fabric such as a ballistic nylon or CORDURA™, similar to the inelastic panels 101, 104, and include a rigid disk disposed between layers of fabric at the top.

As shown in FIG. 10B-10C, the apparatus 11 may include alternative connecting and locking elements from those shown in the apparatus 10 of FIGS. 1A-8. The apparatus 11 includes straps 108*b* that are affixed to one of the static panels 104 and provided on the top, middle and bottom of the mat 100. Connectors 114*a* are arranged on the other static panel 104 and opposite the straps 108*b*. The connectors 114*a* may include one more rings or loops. Each of the straps 108*b* includes two adjacent sections 114*b*, 114*c* that have corresponding connecting elements arranged on the two sections. In the example embodiment shown in FIGS. 10B-10C, the two sections 114*b*, 114*c* have corresponding sections of a hook-and-loop fastener, but in alternative embodiments, the two sections 114*b*, 114*c* may have alternative pairs of corresponding connecting elements, such as buttons or snaps and corresponding receivers, buckle ends, or other connecting elements described herein. When the apparatus 11 is wrapped around a golf bag or other object, each of the straps 108*b* is inserted through one or both rings on the connector 114*a*, and folded over itself, so that the two sections 114*b*, 114*c* of the strap 108 face each other and are capable of engaging one another. In the example embodiment shown in FIG. 10B, this would beam folding the strap 108*b* so that the corresponding sections of the hook-and-loop fasteners 114*b*, 114*c* can engage, which locks the apparatus 11 in a closed configuration, with the strap 108*b* having been inserted through the ring(s) of the connector 114*a*.

The cap 110 of the apparatus 11 may also be entirely detachable from the mat 100. The cap 110 includes a strap 109 having two connecting elements 115 on each end. In the embodiment shown in FIGS. 10A-10C, the connecting elements 115 are female ends of a buckle, but the connecting element 115 may take other forms in other embodiments, including those previously discussed with respect to connectors 112, 115. A pair of corresponding connectors 115*a* may be affixed to panels 101, 104 that are configured to engage the connecting elements 115 and secure the cap 110 to the mat 100. In the embodiment shown in FIGS. 10A-10C, the corresponding connecting elements 115*a* are male ends of a buckle, but the connecting element 115*a* may take other forms in other embodiments, including those previously discussed with respect to connectors 112, 115.

The apparatus 11 also includes a further closure mechanism in the form of strap 118*a* and connector 117, shown in FIG. 10C. In the embodiment of the apparatus 11 shown in the Figures, the further closure mechanism is arranged at the top of the mat 100, but it may be positioned elsewhere on the mat 100 in other embodiments, or omitted from the apparatus 11. An elongated strap 118*a* is provided that is affixed to the static panels 101 and connectors 117 is arranged on one or both of the static panels 104 The connectors 117 may include one more rings or loops. Each of the straps 118*a* includes two pairs of adjacent sections 118*b*, 118*c* that have corresponding connecting elements arranged on the two sections. In the example embodiment shown in FIGS. 10B-10C, the two sections 118*b*, 118*c* have corresponding sections of a hook-and-loop fastener, but in alternative embodiments, the two sections 118*b*, 118*c* may have alternative pairs of corresponding connecting elements, such as buttons or snaps and corresponding receivers. It is further noted that at least one of the sections 118*b*, 118*c* may not be arranged directly on the strap 118*a*, but for example the sections 118*c* may be arranged on a separate pieces of material affixed to the mat 100 and through which the strap 108*b* is inserted to further secure the strap 118*a* to the mat 100. A central strap connecting member 118*d* can also be provided on the static panel 101, through which the strap 118*a* can be inserted, or alternatively, a section of the strap 118*a* can be permanently secured to the static panel 101. When the apparatus 11 is wrapped around a golf bag or other object, each end of the strap 118*a* is inserted through one of the rings on the connector 117, and folded over itself, so that for each pair of sections 118*b*, 118*c*, the two sections 118*b*, 118*c* of the strap 108 face each other and are capable of engaging one another. In the example embodiment shown in FIG. 10B, this would mean folding each end of the strap 118*a* between the elements 118*b*, 118*c* and about the ring of the connector 117 so that the corresponding sections of the hook-and-loop fasteners 118*b*, 118*c* can engage, which locks the apparatus 11 in a closed configuration, with the strap 118*a* having been inserted through the ring(s) of the connector 117.

Alternative embodiments of the apparatus can be provided without departing from the scope of the present application. In one alternative embodiment, the mat comprises the plurality of rods disposed between a first layer material serving to cover the rods, such as nylon, and a second layer of a foam or padded material. The rods may be also removable in such an embodiment. In further embodiments, the cap may take the form of a flat, protective plate covering the end of the tubular configuration of the mat. In another alternative embodiment, the support rods comprise a hinge along their length, allowing the mat to be folded. In a further alternative embodiment, the cap of the apparatus may also be configured in a manner similar to the mat 100, wherein it is made from a similar material and has rods disposed in the material, but comprises a closed end. In further embodiments, the apparatus may include a base or cap as described above with or without wheels and an associated handle for transporting the case and equipment therein.

In still further embodiments, one or more of the front or rear static panels 101, 104 can include one or more folded portions comprising a removable seam, so that the size of the panels can be adjusted and increased if necessary for enclosing larger objects. For example, the panel can be provided in the form of a sheet of fabric material having a first width, and a portion of the fabric is folded upon itself and a removable seam is provided along the length of the fold, so that the panel has a second and shorter width. If the apparatus with the shortened panel(s) needs to have an increased perimeter for containing a larger object, the seam can be removed, so that the perimeter of the apparatus is increased. Multiple folded portions can be provided on the mat 100 portion of the apparatus, so that multiple adjustments can be made. Further, in certain such embodiments, the removable seam can be presented in a different color or with further indicia to distinguish the removable seam from other seams on the apparatus, and can be arranged in a manner that is easier to remove than other seams on the apparatus, such as comprising a zipper.

Various elements of the embodiments described herein can be combined or substituted with elements of other embodiments described above, without departing from the scope of the invention. For example, the straps 108 may include a surface having hook and loop, magnetic, or snap/button fastening elements that are configured to engage a corresponding surface on the mat 100

As used herein, directional or positional terms such as "upper", "lower", "top", "bottom", etc., are used for explanatory purposes only to describe the apparatus having the orientation shown on the page for example in FIG. 1A.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A system comprising:

an elongated article, wherein the elongated article is a golf bag; and an apparatus for enclosing and protecting the elongated article comprising:

a mat comprising:

an inner surface and an outer surface;

a first lateral edge and a second lateral edge that are opposite from each other and perpendicular to top and bottom edges; and a plurality of elongated support rods disposed in between and substantially parallel to the first lateral edge and second lateral edge, and each disposed in between the inner surface and the outer surface of the mat;

wherein the mat is configured to be convertible between:

a first flattened configuration configured to receive the elongated article on the inner surface of the mat;

a second tubular configuration configured to encase the elongated article within the mat; and a third spiral configuration, in which the mat is rolled into an elongated arrangement having a spiral cross-section.

2. The system according to claim 1, wherein the mat further comprises a plurality of panels disposed laterally in between the first lateral edge and the second lateral edge, each of the plurality of panels comprising an inner surface, which collectively form an inner surface of the mat, and each of the plurality of panels further comprising an outer surface, which collectively form an outer surface of the mat.

3. The system of claim 1, wherein the mat further comprises a plurality of pockets arranged on the inner surface of the mat, each of which is configured to receive and enclose one of the plurality of elongated support rods.

4. The system of claim 2, wherein the plurality of panels comprise at least one static panel made from a first material, and at least one expandable panel made from a second material, wherein the second material is more elastic than the first material.

5. The system of claim 4, wherein the mat comprises a plurality of static panels and a plurality of expandable panels.

6. The system of claim 4, wherein a cross-sectional diameter of the tubular configuration of the mat is expandable in dependence upon the diameter of the elongated article encased therein.

7. The system of claim 1, wherein the mat further comprises a plurality of connectors having interacting connecting elements disposed on the mat configured to lock the mat into the second, tubular configuration to encase the elongated article.

8. The system of claim 7, wherein each of the plurality of connectors comprises:

a first connecting element arranged at the first lateral edge of the mat, and a second connecting element arranged at the second lateral edge of the mat opposite the first connecting element, the second connecting element configured to engage the first connecting element.

9. The system of claim 8, wherein the mat is converted from the first flattened configuration to the second tubular configuration by bringing together the first lateral edge and the second lateral edge, and engaging the first and second connecting elements of the plurality of connectors.

10. The system of claim 9, wherein each of the first connecting elements comprises one or more rings, and each of the second connecting elements comprises a strap including two adjacent sections that have corresponding connecting elements; and wherein the straps of each of the second connecting elements are configured to pass through the one or more rings of each of the first connecting elements, and be folded over so that the two adjacent sections of the straps engage each other via the corresponding connecting elements.

11. The system of claim 10, wherein the two adjacent sections of each of the straps of the second connecting elements comprise corresponding hook-and-loop fastener elements.

12. The system of claim 1, further comprising a carrying handle disposed on the outer surface of the mat.

13. The system of claim 1, further comprising a cap configured to cover an open end of the mat in the tubular configuration, wherein the cap comprises at least one locking element configured to engage a corresponding locking element on the outer surface of the mat to secure the cap into a position covering the open end of the mat in the tubular configuration.

14. The system according to claim 13, wherein the cap further comprises a strap having two ends configured be secured to the outer surface of the mat, and wherein at least one of the two ends comprises the at least one locking element.

* * * * *